United States Patent [19]

Bergholm

[11] 4,049,543

[45] Sept. 20, 1977

[54] METHOD FOR THE SEPARATION OF A MIXTURE OF PETROLEUM ACIDS FROM PETROLEUM DISTILLATES CONTAINING SUCH A MIXTURE

[75] Inventor: Carl Arne Bergholm, Nynashamn, Sweden

[73] Assignee: AB Nynas-Petroleum, Stockholm, Sweden

[21] Appl. No.: 559,854

[22] Filed: Mar. 19, 1975

[30] Foreign Application Priority Data

Mar. 19, 1974 Sweden ..... 7403685

[51] Int. Cl.[2] ..... C10G 17/00; C10G 19/00

[52] U.S. Cl. ..... 208/263

[58] Field of Search ..... 208/263, 259, 283, 284, 208/286, 288

[56] References Cited

U.S. PATENT DOCUMENTS

| | | | |
|---|---|---|---|
| 2,034,197 | 3/1936 | Morrell | 208/259 |
| 2,685,558 | 8/1954 | Hodges | 208/263 |
| 2,868,722 | 1/1959 | Brooks, Jr. et al. | 208/263 |

FOREIGN PATENT DOCUMENTS

| | | | |
|---|---|---|---|
| 552,431 | 1/1958 | Canada | 208/263 |

*Primary Examiner*—George Crasanakis
*Attorney, Agent, or Firm*—Fred Philpitt

[57] ABSTRACT

A mixture of petroleum acids can effectively be separated from a petroleum distillate containing such a mixture by adjusting the molecular weight distribution of the petroleum acids in the mixture so that at least 10% of the acids have a molecular weight of less than 260 and at least 50% of the acids have a molecular weight of more than 260, treating the petroleum distillate with an aqueous solution of sodium hydroxide which solution is added with at least 5% of a sodium salt, calculated on the weight of the aqueous solution, at a temperature of at least 85° C in one or more reactors to the formation of a reaction mixture containing three phases and causing said three phases to separate.

15 Claims, 1 Drawing Figure

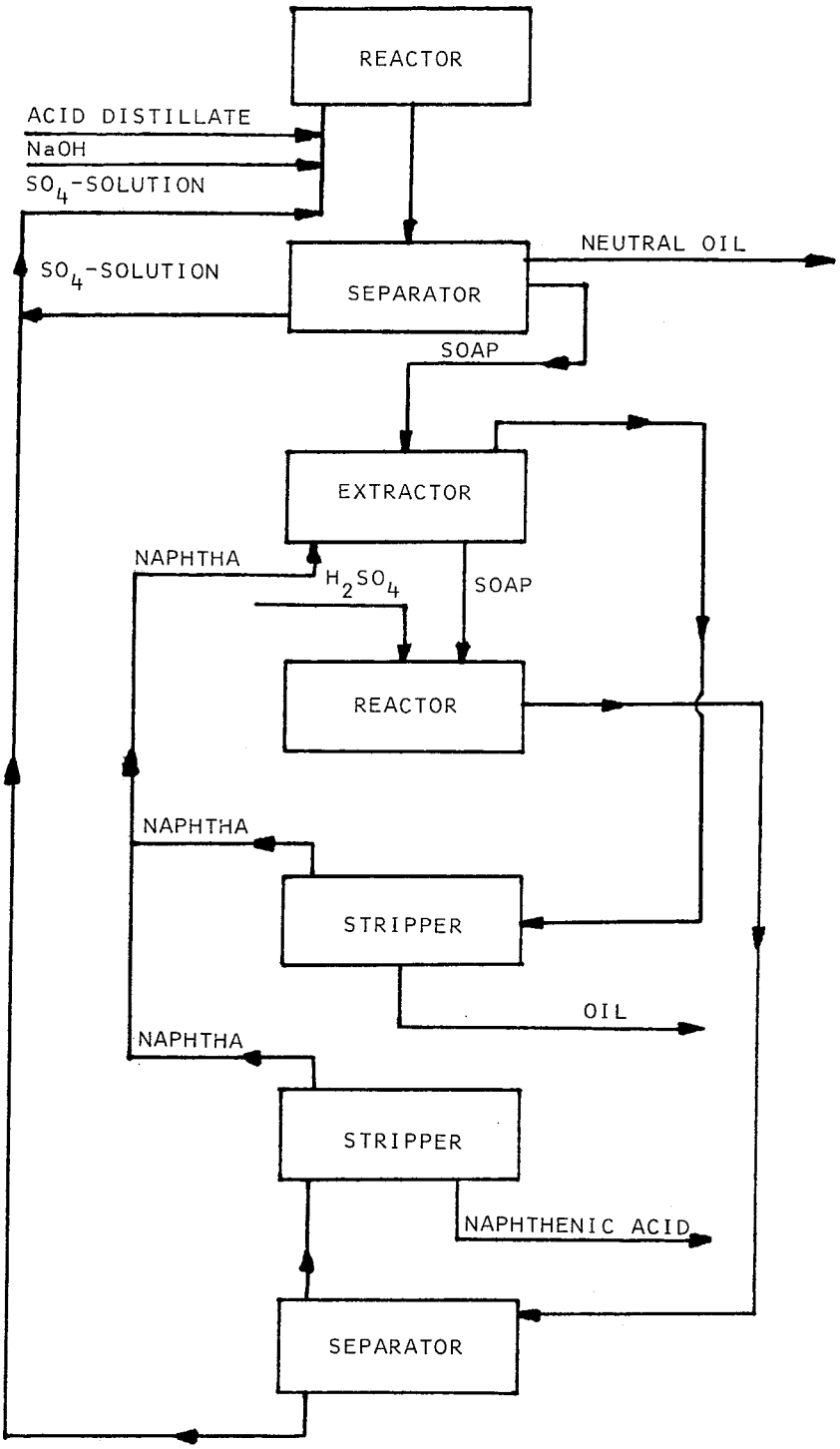
REACTOR
ACID DISTILLATE
NaOH
$SO_4$-SOLUTION
NEUTRAL OIL
$SO_4$-SOLUTION
SEPARATOR
SOAP
EXTRACTOR
NAPHTHA
$H_2SO_4$
SOAP
REACTOR
NAPHTHA
STRIPPER
OIL
NAPHTHA
STRIPPER
NAPHTHENIC ACID
SEPARATOR

METHOD FOR THE SEPARATION OF A MIXTURE OF PETROLEUM ACIDS FROM PETROLEUM DISTILLATES CONTAINING SUCH A MIXTURE

The present invention relates to a method for the separation of a mixture of petroleum acids from petroleum distillates containing such a mixture. The term "petroleum acids" as used here and in the claims is used to designate organic acids of the type which are present in most crude oils in varying amounts. On distillation of the crude oil, part of these acids is passed over into the distillates. The object of the present invention is to enable the preparation of petroleum acids in comparatively pure form and the neutralization of the petroleum distillates.

Petroleum acids is a summarizing name of a number of acids which acids from chemical point of view are of very different structures. The best known group of petroleum acids is the so-called naphthenic acids which contain a hydroaromatic carbon ring, e.g. cyclopentane or cyclohexane, with a carbonyl group in a side chain. Naphthenic acids of higher molecular weights are often bicyclic, one of the rings being sometimes an aromatic one. The remaining acid constituents of the crude oil are i.a. fatty acids and phenols. The molecular weight of the petroleum acids varies from about 100 400 or more than that. Petroleum acids sold on the open market, which acids often quite improperly are called naphthenic acids, have a molecular weight of about 200 and contain generally 10 - 20% of hydrocarbons.

Low molecular weight petroleum acid of the type usually called naphthenic acid is prepared by treatment of intermediate distillates from the distillation of crude oil which distillates are lying within the boiling point interval of 180° - 350° C with an aqueous solution of sodium hydroxide, the petroleum acids of the distillate being neutralized. By this treatment a first comparatively light phase consisting of practically neutral petroleum distillate and a second somewhat heavier phase consisting of an aqueous mixture containing sodium salts of the petroleum acids will arise. Said second phase is separated off and treated with a mineral acid, preferably sulphuric acid, to split the sodium salts into the free acids. If this process technique is applied to distillates having a boiling point of more than about 350° C the treatment with an aqueous solution of sodium hydroxide will lead to the formation of serious emulsions which cannot be caused to separate within reasonable periods. For this reason, the high boiling distillates are in most cases neutralized in the fractionating column by supplying sodium hydroxide or lime. The fractionating column will in this case of necessity become more complicated and in addition to that the petroleum acids will be obtained in a very impure form, which in practice makes their preparation in pure form impossible, at the same time as great losses of oil will arise.

The Swedish patent publications Nos. 349,054 and 357,573 describe a method for the neutralization of petroleum acids from high boiling distillates (so-called vacuum distillates) with sodium hydroxide in the presence of a low molecular weight alcohol. The method certainly leads to very favourable separation results but it necessitates a far-reaching recovery of the solvent, which recovery requires heat and an advanced plant.

In connection with the rise of the present invention, it has been found after an extensive experimental work that the neutralization of high-boiling acid petroleum distillates may also be performed without any inconvenient formation of emulsions by selecting particular process conditions. The invention is based on the discovery that petroleum distillates containing petroleum acids of both a comparatively low molecular and a comparatively high molecular type on neutralization with an aqueous solution of sodium hydroxide, preferably in excess, said solution being added with comparatively large amounts of more than about 5% of weight of a sodium salt, readily separates into three phases, namely a comparatively light first phase consisting of practically acid-free petroleum distillate, a second somewhat heavier phase consisting of an aqueous mixture containing sodium salts of the petroleum acids in comparatively concentrated form and a third still heavier phase consisting of an aqueous solution of sodium salts. The second intermediate phase may comprise to about equal parts of a solution of sodium salts and oil with about 10% of sodium salts of the petroleum acids, calculated on the weight of the whole phase.

The most essential conditions for the formation of three different phases in accordance with the above are as follows:

1. The petroleum acids should suitably have a molecular weight distribution such that at least about 10% of the acids have a molecular weight of less than 260 and at least about 50% of the acids have a molecular weight of more than 260.

The condition that the mixture of petroleum acids to be separated from the petroleum distillate has a correct composition in accordance with what has been stated above and is prescribed in the main claim is of the greatest importance in order to obtain a sharp and rapid separation into the three phases. The correct molecular weight distribution may be attained either by mixing suitable amounts of distillates having different boiling point intervals, i.e. different molecular weight ranges, or by adding petroleum acids of the molecular weight interval which is missing in a given distillate. In case of a given crude oil the molecular weight distribution of the petroleum acids may be as follows:

10–20% within the boiling point interval of from 260° to 360° C

80–90% within the boiling point interval of from 325° to 450° C.

These boiling point intervals correspond to molecular weights between about 200 and 260 and between 230 and 400, respectively.

Similar proportions have been shown in another crude oil, in which oil, however, a smaller part of petroleum acids having a molecular weight of more than 400 was represented. The man of ordinary skill in the art, has in his hands to establish the most suitable combination of the petroleum acids for each petroleum distillate by means of suitable pre-experiments.

2. The aqueous solution of sodium hydroxide should be added with at least about 5% of a sodium salt, suitably sodium sulphate, calculated on the weight of the aqueous solution. If the sodium salt added is sodium sulphate the contents thereof should suitably amount to 10 - 15%, calculated on the weight of the aqueous solution. It has been established that particularly favourable results are obtained when the aqueous solution of sodium hydroxide is added with about 13% of sodium sulphate, calculated as above.

3. The temperature of the reactor or of the reactors wherein the neutralization is carried out should be at least about 85° C, preferably at least 95° C. The result of the neutralization will be impaired if the water is allowed to boil. Thus, if one wants to work at a temperature above 100° C when carrying out the neutralization it will be necessary to work at pressures above the atmospheric. Excellent results may be obtained at temperatures of as much as 110° C. Still higher temperatures e.g. 125° C may possibly be used provided care is taken to avoid boiling by adjusting the pressure.

On the basis of the above the present invention is related to a method according to the above, which method comprises treating the petroleum distillates containing the mixture of petroleum acids with an aqueous solution of sodium hydroxide, which solution is added with at least about 5% of a sodium salt, calculated on the weight of the aqueous solution, at a temperature of at least about 85° C, the molecular weight distribution of the petroleum acids in the mixture being adjusted so that at least about 10% of the acids have a molecular weight of less than 260 and at least about 50% of the acids have a molecular weight of more than 260, in one or more reactors to the formation of a reaction mixture containing a first phase consisting of practically neutral petroleum distillate, a second heavier phase consisting of an aqueous mixture containing sodium salts of the petroleum acids and a third still heavier phase consisting of an aqueous solution of sodium salt, whereafter the phases are caused to separate.

The excess of sodium hydroxide of the aqueous solution of sodium hydroxide, the reaction time and the composition and the molecular weight of the oil-containing phase are factors which have an influence upon the effectiveness of the neutralization and the separation. Although, theoretically no excess sodium hydroxide is needed beyond what is stoichiometrically required in order to neutralize the petroleum acids of the petroleum distillate, it has turned out in practice that considerably improved results are obtained if such an excess is used. Said excess may amount to as little as 10% but in practice about 50% is recommended even if no considerable improvement could be established at an excess of more than about 60%. In a discontinuous way of working the contact between the aqueous solution of sodium hydroxide and sodium salt and the petroleum distillate may suitably be caused to take place for at least about 2 minutes. In a continuous way of working the contact between the aqueous solution of sodium hydroxide and sodium salt and the petroleum distillate may suitably be caused to take place for at least 5 minutes. The chemical composition of the petroleum distillate is a factor which influences upon the speed and sharpness with which the separation may be caused to proceed. It has been found that the petroleum distillate should contain certain amounts of aromatic hydrocarbons in order that a separation into three phases shall take place as above. This provision is not difficult to comply with since in practice all distillates from crude oils independently of the find-spot contain a sufficient amount of aromatic hydrocarbons for the present purpose. According to the invention, it has also been found that the mixing in of neutral distillates having a relatively low molecular weight within the range of from 120 to 200 leads to favourable results in the separation. The mixing in of high molecular weight distillates, on the other hand, impairs the separation result.

According to the invention it has turned out that a more rapid separation between the first phase and the second heavier phase containing sodium salts of the petroleum acids can be obtained if a certain amount of aqueous phase is present at the same time. In order to achieve this improved result, i.e. a more rapid separation of the three phases, the volume of the petroleum distillate and the volume of the aqueous solution of sodium hydroxide containing sodium salt should be about equal. When the volume of the aqueous phase was further increased no appreciable improvement in the separation was observed. When the volume of the aqueous phase was decreased considerably, however, a strong deterioration of the separation was obtained.

The intermediate phase obtained in the neutralization and division into phases which intermediate phase contains sodium salts of the petroleum acids in addition thereto also contains relatively great amounts of oil. For that reason the density thereof will be between the density of neutral oil phase and the density of the heaviest phase consisting of an aqueous solution of sodium salt. The phase containing sodium salts of the petroleum acids may be worked up directly to split the salts by means of a mineral acid, i.e. in practice by means of sulphuric acid. This splitting results in a solution of the petroleum acids in oil which solution contains about 4 parts of oil per one part of petroleum acids. The acid number of this solution is about 40 g of KOH per kg of solution whereas the acid number of the pure acid is about 175.

In order to enable a more general use of the petroleum acids the intermediate phase from the neutralization and separation process above should be subjected to a concentration process. To this end the intermediate phase which contains sodium salts of the petroleum acids may be treated with a solvent for oils after separation of the other two phases, which treatment is performed in order to extract hydrocarbons which are present in the phase and which originate from the petroleum distillate used as the starting material. Petroleum distillates within the boiling point interval of 50° - 250° C, i.e. either benzine or naphtha, can be used as the solvent for oils in the extraction. In this connection, it is most suitable to use naphtha having a boiling point interval of 150° - 220° C i.a. because of the reduced inflammability. Suitably the extraction process is carried out at a temperature of 90° - 100° C and at atmospheric pressure using naphtha in an apparatus for counter-current extraction. The amount of naphtha in the extraction should be at least about 50% of the volume of the intermediate phase, preferably 75 - 125% of the volume of the intermediate phase. In the extraction process part of the oil will be dissolved in the solvent for oils and forms a supernatant while the aqueous solution of sodium salts of petroleum acids, which solution also contains solvent for oils, after separation forms a lower phase. After separation of the two phases from each other, the lower phase, i.e. the raffinate phase from the extraction, is treated with a mineral acid, preferably sulphuric acid, to split the sodium salt and to set free the petroleum acids which are obtained in the form of a solution in the solvent for oils. The separation between the solution of petroleum acids in the solvent for oils and the aqueous phase containing the sodium salt of the mineral acid can be carried out in a gravity separator or in a centrifugal separator. If the naphtha has a lower boiling point or a lower boiling point interval the solution of petroleum acids in the solvent for oils may be subjected to stripping and the vapours of the solvent evaporating in the stripping are fed back to the extraction step of the intermediate phase after condensation.

In the accompanying drawing there is shown a flow sheet for a complete process for the recovery of petroleum acids from a petroleum distillate containing such acids. A practically neutral oil (acid number <0.05) and a mixture of petroleum acids having an acid number of 130 - 150 are obtained in the process. The term "soap" is used in the flow sheet to designate sodium salts of the petroleum acids.

What is claimed is:

1. The method which comprises a. providing a liquid petroleum distillate containing a mixture of petroleum acids, at least 10% of the petroleum acids having a molecular weight less than 260 and at least 50% of the acids having a molecular weight of more than 260, b. treating said petroleum distillate in at least one reaction zone with the combination consisting of:

1. an aqueous solution of sodium hydroxide, and
2. sodium sulfate in an amount equal to 10 - 15% by weight of the aqueous solution of sodium hydroxide, said treatment being carried out at a temperature of at least 85° C, to thereby form a reaction mixture containing a first phase consisting of neutral petroleum distillate, a second heavier phase consisting of an aqueous mixture containing sodium salts of the petroleum acids, and a third still heavier phase consisting of an aqueous solution of sodium sulfate, and c. separating said first, second and third phases from one another.

2. A method according to claim 1 wherein the molecular weight distribution of the petroleum acids is 10 - 20% within the range 200 - 260 and 80 - 90% within the range of 230 - 400.

3. A method according to claim 1 wherein the temperature of said at least one reaction zone is within the range of from 85° to 125° C.

4. A method according to claim 1, wherein the aqueous solution of sodium hydroxide is added to the reaction zone with 13% of sodium sulphate, calculated on the weight of the aqueous solution.

5. A method according to claim 1 wherein the contact between the aqueous solution of sodium hydroxide and sodium sulphate and the petroleum distillate in a batch process is caused to take place for at least 2 minutes.

6. A method according to claim 1 wherein the contact between the aqueous solution of sodium hydroxide and sodium sulphate and the petroleum distillate in a continuous process is caused to take place for at least 5 minutes.

7. A method according to claim 1 wherein the sodium hydroxide is added in a stoichiometric excess beyond what is required for the neutralization of the petroleum acids.

8. A method according to claim 22 wherein the excess amounts to up to 60%.

9. A method according to claim 1 wherein the volume amounts of the petroleum distillate containing petroleum acids and of the aqueous solution of sodium hydroxide and sodium sulphate are adjusted in such a way that after the separation into three phases the volume of the aqueous solution of sodium sulphate is at least equally large as the volume of the neutral petroleum distillate.

10. A method according to claim 1 wherein a neutral distillate having an average molecular weight between 120 and 200 is introduced into the reaction zone in order to facilitate still more the separation of the reaction mixture into three phases.

11. A method according to claim 1 wherein said second phase containing sodium salts of petroleum acids, after separation of the two other phases, is treated with a solvent for oils to extract hydrocarbons.

12. A method according to claim 11 wherein the solvent for oils is naphtha having a boiling point which is lower than that of the petroleum acids.

13. A method according to claim 11 wherein said second phase containing sodium salts of petroleum acids is extracted with a solvent for oils to produce a raffinate phase which is then acidified to liberate the petroleum acids contained in the raffinate phase, separating a solution of petroleum acids from the aqueous phase containing salt formed during the liberation of the petroleum acids, and distilling said solution of petroleum acids in order to separate the petroleum acids from the solvent contained in the said raffinate phase.

14. A method according to claim 13 wherein said solvent has a boiling point which is lower than that of the petroleum acids.

15. A method according to claim 11 wherein the extract phase contains hydrocarbons from the petroleum distillate dissolved in said solvent and is subjected to stripping and the solvent resulting from the stripping is fed back to the extraction step after condensation.

* * * * *